United States Patent [19]

Anders

[11] Patent Number: 4,574,868

[45] Date of Patent: Mar. 11, 1986

[54] FLOW DIRECTING ELEMENT FOR HEAT EXCHANGER

[75] Inventor: Gene A. Anders, Peoria, Ill.

[73] Assignee: Caterpillar Tractor Co., Peoria, Ill.

[21] Appl. No.: 307,969

[22] Filed: Oct. 2, 1981

[51] Int. Cl.[4] ..... F28F 9/26; F28F 13/12; F28D 1/04

[52] U.S. Cl. ..... 165/144; 165/124; 165/151; 165/903

[58] Field of Search ..... 165/148, 149, 151, 124, 165/125, 126, 152, 153, 172, 144, DIG. 5

[56] References Cited

U.S. PATENT DOCUMENTS

| | | | |
|---|---|---|---|
| 1,227,770 | 5/1917 | Fleischmann | 165/149 |
| 3,727,679 | 4/1973 | Von Cleve | 165/125 |
| 3,831,670 | 8/1974 | Mullings | 165/124 |
| 3,885,936 | 5/1975 | Limebeer | 165/172 |
| 4,034,804 | 7/1977 | Meijer et al. | 165/148 |
| 4,116,265 | 9/1978 | Staebler | 165/103 |
| 4,144,933 | 3/1979 | Asselman et al. | 165/124 |
| 4,159,738 | 7/1979 | Sedille | 165/125 |

FOREIGN PATENT DOCUMENTS

| | | | |
|---|---|---|---|
| 464531 | 4/1937 | United Kingdom | 165/124 |

*Primary Examiner*—William R. Cline
*Assistant Examiner*—John K. Ford
*Attorney, Agent, or Firm*—William B. Heming

[57] ABSTRACT

Heat exchangers depend for efficiency upon optimum fluid flow, such as air, through their fins and about tubes extending through the fins. The air flow, particularly at the ends of a heat exchanger, can sometimes be of a significantly reduced amount owing to the construction of, or arrangement of elements in, the heat exchanger. First and second cores (12,14) of a heat exchanger (10) are positioned in a general "V" configuration with their inlet ends (24,42) adjacent one another. Apparatus (64) is provided upstream of the inlet ends (28,46) of the cores (12,14) to direct the air flow in a preselected orientation to inlet surfaces (20,38) of the cores (12,14) at the ends (28,46) of the cores (12,14). Air flow is thus improved over a portion of the heat exchanger (10) to increase its heat transfer efficiency.

7 Claims, 3 Drawing Figures

FLOW DIRECTING ELEMENT FOR HEAT EXCHANGER

DESCRIPTION

1. Technical Field

The invention relates to heat exchangers and, more particularly, to means for optimally directing flow across the heat exchangers.

2. Background Art

In the use of heat exchangers, heat dissipation characteristics for a particular application can be maximized by increasing surface area and maintaining a proper flow of air across all portions of the surface area.

For example, work vehicles often provide limited space in which to position a heat exchanger to cool engine oil or water or hydraulic fluid. One solution is to utilize a folded core heat exchanger which positions cores of the heat exchanger at angles or in a zigzag pattern. This provides more surface area for a given width in which to place the cores. Such a heat exchanger is shown in U.S. Pat. No. 4,116,265 which issued to Paul J. Staebler on Sept. 26, 1978.

The use of the folded core heat exchangers does, however, result in different flow characteristics through the cores because of the angular arrangement of the cores relative to air flow. Further, because space limitations also restrict the size of the folded core heat exchanger, plus the expense of providing larger cores than needed, it is desirable to fully utilize the entire heat exchanger area of a core to make maximum use of its capacity.

One solution to make maximum use of a folded core heat exchanger is disclosed in U.S. Pat. No. 4,034,804 which issued to Meijer et al on July 12, 1977. In said patent, the hydraulic diameters and lengths of the tubes are specifically selected to increase the cooling capacity of the disclosed radiator. Another solution is disclosed in U.S. Pat. No. 4,144,933 which issued to Asselman et al on Mar. 20, 1979, in which the fins of the cores of a folded core heat exchanger are bent to influence air flow characteristics thrugh the heat exchanger.

However, even with such heat exchangers, optimum air flow, and therefore maximum efficiency, can sometimes be substantially reduced, such as when air flow is partially blocked from flowing through the fins and about the tubes in certain portions of the core. Full or optimum air flow through all portions of a core can be affected by, for example, mounting or connecting brackets for the cores at the core ends. The arrangement of the fins or tubes themselves can also block or restrict the optimum pathway of the air through a core, such as by deflecting air flow away from adjacent portions of the core.

The present invention is directed to overcoming one or more of the problems set forth above.

DISCLOSURE OF THE INVENTION

In one aspect of the present invention, a heat exchanger has a first core and a second core positioned in a general "V" configuration with the first core. A plurality of tubes in each of the first and second cores define first and second planes, respectively; and the planes intersect to form a planar angle. A flow control element is positioned in the planar angle. A leading or upstream side of the flow control element tangentially intersects the first and second planes.

In a heat exchanger, the flow of fluid, such as air, through the heat exchanger can sometimes be interrupted or misdirected at and through certain portions owing to the construction of the heat exchanger or its related components. This reduces efficiency of the heat exchanger by not utilizing the flow of air in the best manner across the heat exchanger. The flow control element directs the flow of air in an optimum orientation to make full use of the leading or upstream portions of the heat exchanger.

BEST MODE FOR CARRYING OUT THE INVENTION

Figure 1:
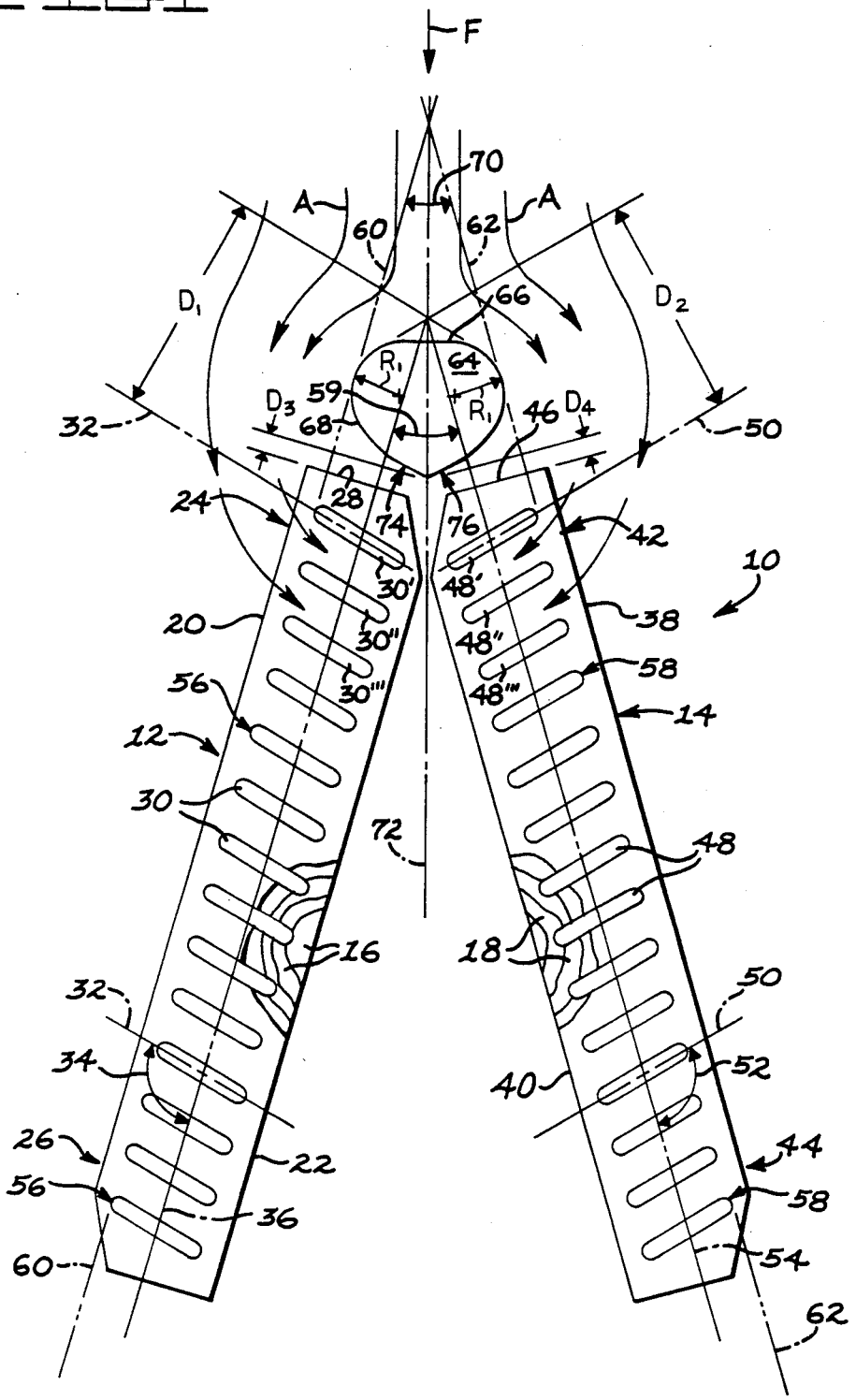
FIG. 1 is a diagrammatic plan view in the elevation of a heat exchanger having its cores arranged in a "V" configuration and incorporating one embodiment of the present invention.

Referring to the drawings, and particularly to FIG. 1, a heat exchanger 10 for utilizing a fluid stream has a first core 12 and a second core 14 oriented in a general "V" configuration with the first core. The first and second cores are defined by a first plurality of fins 16 and a second plurality of fins 18, respectively. The first core has inlet and outlet surfaces 20,22, inlet and outlet ends 24,26, and an inlet end surface 28 defining a portion of the inlet surface. A first plurality of tubes 30 extends through the first core. Each of the tubes is elongated in cross section and has a longitudinal axis 32 which defines a preselected angle 34 with a central axis 36 of the first core. The second core also has inlet and outlet surfaces 38,40, inlet and outlet ends 42,44, and an inlet end surface 46 defining a portion of the inlet surface. Further, a second plurality of tubes 48 extends through the second core in a manner similar to the tubes 30 of the first core 12. Each of the tubes is elongated in cross section and has a longitudinal axis 50, defining a preselected angle 52 with a central axis 54 of said second core. The tubes of both the first and second cores have leading edges 56,58 adjacent the inlet surfaces of their respective cores which represent the upstream portions of the tubes.

Generally, in the "V" configuration in which the first and second cores 12,14 are positioned, the inlet end 42 of the second core is positioned closely adjacent the inlet end 24 of the first core. The inlet surfaces 20,38 face outwardly relative to the "V" and into an impinging fluid stream, which is typically directed at the heat exchanger 10 in a flow direction identified by reference letter F. A preferred value of the included angle 59 of intersection of the central axes 36,54 is from about 20° to about 78°. For the preselected angle 34 of, for example, the tubes of the first core, a preferred value is from about 100° to about 120°. Such preferred angles tend to optimize flow F across the heat exchanger to fully utilize the heat exchange capacities of the individual cores. Additional cores (not shown) can be positioned in similar "V" configurations adjacent the first and second cores to increase the size and cooling capacity of the heat exchanger.

In the heat exchanger 10, the rounded ends or extreme upstream portions of leading edges 56,58 of the tubes 30,48 in the first and second cores 12,14 define first and second planes 60,62, respectively, which intersect owing to the "V" configuration of the cores. A single flow directing element 64 with a leading or upstream side 66 and a trailing or downstream side 68 is positioned in the fluid stream forwardly or upstream of the inlet end surfaces 28,46 to direct the fluid stream flow F in a desired orientation onto the inlet ends 24,42 of the cores. The flow directing element is positioned within a planar angle 70 defined by the intersecting first and second planes with its leading or upstream side 66 tangentially intersecting both of the first and second planes.

The location of the flow directing element 64 can also be based upon a distance $D_1$, $D_2$ from the axis 32,50 of a tube 30,48 in both corres (preferably the respective leading tubes 30',48') to a point on the leading side 66 of the flow directing element. It will be readily understood, that for a particular configuration of the flow directing element and core arrangement the distances $D_1$, $D_2$ can be calculated to position the flow directing element with its leading side 66 tangent to the first and second planes 60,62.

Figure 2:
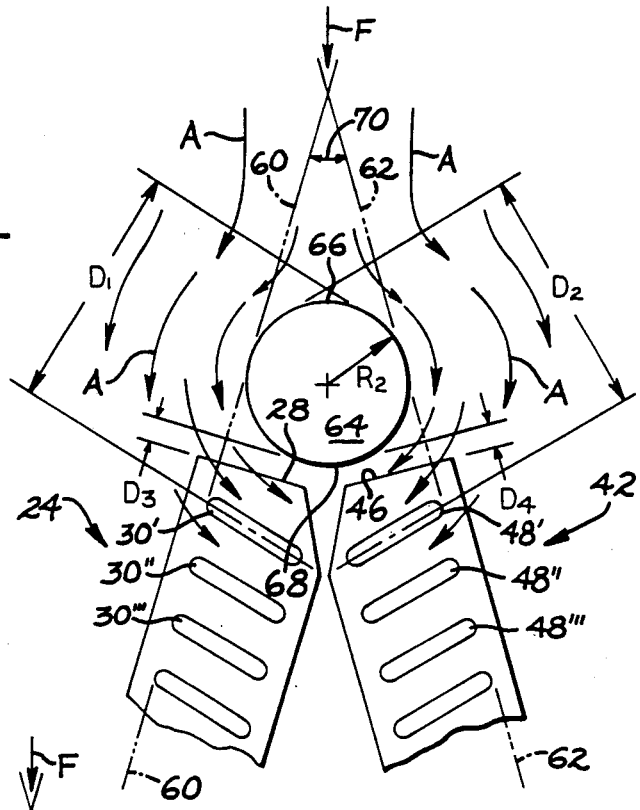
FIG. 2 is a diagrammatic plan view similar to FIG. 1 which discloses another embodiment of the invention.
Figure 3:
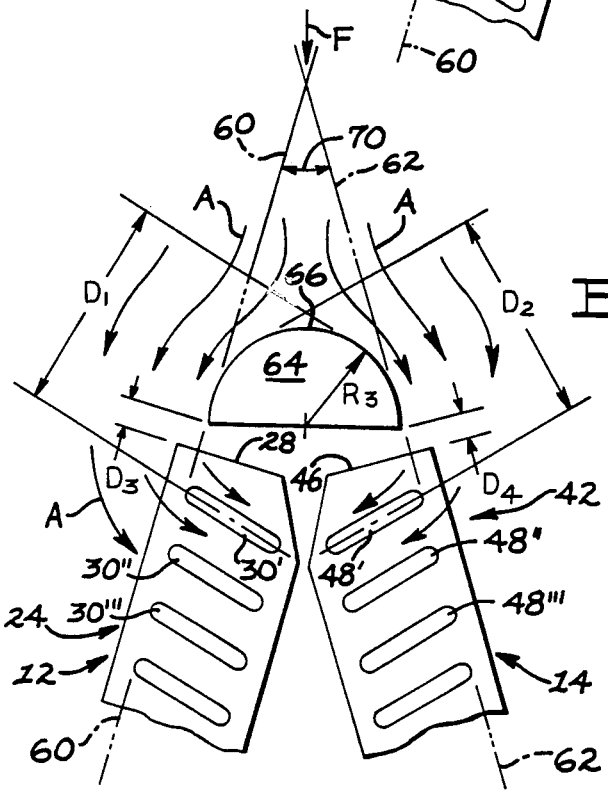
FIG. 3 is a diagrammatic plan view similar to FIG. 1 which shows yet another embodiment of the invention.

Referring more particularly to the configuration of the flow directing element 64, the leading side 66 preferably is arcuately and aerodynamically shaped to extend uninterruptedly between the first and second planes 60,62 and to be symmetrical about a plane 72 bisecting the planar angle 70. Such a configuration will tend to reduce turbulence and create similar flow characteristics across both the first and second cores. In the embodiments shown, the leading side 66 intersects said first and second planes on the same radius $R_1$. In FIGS. 2 and 3, the leading sides 66 extend about a constant radius ($R_2$, $R_3$) between the first and second planes in circular and semi-circular configurations, respectively. It is also desirable that the trailing side 68, and thus the entire flow directing element, be symmetrical about the bisecting plane 72. In FIG. 1, the trailing side is shown having respective portions 74,76 parallel to the most closely adjacent or leading tubes 30',48' of the first and second cores 12,14.

It should be understood that the heat exchanger 10 and particularly the flow directing element 64, can be of other configurations as is known in the art without departing from the invention.

INDUSTRIAL APPLICABILITY

During use of the heat exchanger 10, the fluid stream, which is commonly a flow of air induced by a fan or movement of an associated vehicle, passes through the cores 12,14 to dissipate heat transferred to the fins 16,18 by fluid, such as engine water, traveling through the tubes 30,48. The efficiency of the heat exchanger therefore depends upon the characteristics of the air flow past the tubes and through the finned area.

One of the area sensitive to air flow in a heat exchanger such as that shown is in the region of the inlet ends 24,26 of each core 12,14. It will be understood from a study of the drawings, that air flow about and between the leading or upstream tubes (i.e. 30',30'',30''',48',48'',48''') at the inlet ends 24,42 can be significantly reduced, or misdirected therethrough, depending upon the construction or connection of the cores at their inlet ends. This can occur, for example, where a bracket is placed against and across the inlet end surfaces 28,46 such as might be used to interconnect and mount the cores. Flow of the air will be blocked at the inlet surfaces 20,38 at the inlet ends 24,42 and will also be deflected outwardly by the bracket. The outwardly deflected air flow will tend to bypass the core areas adjacent the leading tubes, although some of the flow will be directed therethrough in a significantly reduced amount or in undesirable directions. Such will even be the case to some extent where there are no covers or other restrictions and air flows directly onto and is deflected by the sides of the leading tubes 30' and 48'.

The flow directing element 64 improves flow characteristics at the inlet ends 24,42 of the first and second cores 12,14 owing to its configuration and its position relative to the inlet ends. The improved air flow is represented by way of example by the flow lines A which demonstrate that streamlined, outward deflection of the air flow at the flow directing element is not so great as to result in the flow bypassing the leading tubes 30,48. In operation, the shape of the flow directing element is such that the flow is redirected to impinge on the inlet surfaces 20,38 in a direction generally parallel to the leading tubes. The effect is to reduce the turbulence, as well as to direct the flow where desired and at a velocity nearly the same as air flow passing through the other portions of the core.

In the embodiments shown, it is believed that flow across the first and second cores 12,14 is further benefited owing to the position of the flow directing element 64 at the location spaced preselected distances $D_3$, $D_4$ from the fins 16,18 at the inlet ends 24,42. This construction effectively increases the inlet surface area of the heat exchanger by providing flow through the entire fin surace area at the inlet end surfaces 28,46 and about the leading tubes 30',48' on their sides facing the flow directing element. The flow directing element can be positioned in direct contact with the fins, but it must be spaced at least some distance from the leading tubes 30',48' in order to induce air flow across said tubes and also the adjacent tubes.

The flow directing element 64 can be connected either to the cores 12,14 or to a grill positioned in front of the heat exchanger 10. The cores themselves are best mounted to, for example, a vehicle by being held through brackets attached at their top surfaces and at their bottom surfaces. A particular configuration, size and location of the flow directing element will depend upon the angles at which the cores are positioned one relative to the other and the angles and spacing of the tubes or other construction details of the cores. A flow directing element can also be used with a heat exchanger in which the cores can be turned around (the outlet surfaces 22,40 being resultingly positioned upstream in the air flow) to reverse air flow therethrough to purge debris from the cores. to accommodate the reversal feature, an additional flow directing element can be connected to the heat exchanger 10 adjacent the outlet ends 26,44 of a flow directing element can be fixed to a grill to confront the cores as they are reversed.

Other aspects, objects and advantages will become apparent from a study of the specification, drawings and appended claims.

I claim:

1. A heat exchanger (10) for receiving a fluid stream (F), comprising:

a first core (12) having a plurality of tubes (30), said tubes (30) including a leading tube (30') and each having a leading edge (56) and each being elongated in cross section, said leading edges (56) defining a first plane (60), said leading tube (30') being upstream of the other tubes (30) in said fluid stream (F);

a second core (14) having a plurality of tubes (48) and being positioned in a "V" configuration with said first core (12), said tubes (48) of said second core (14) including a leading tube (48') and each having a leading edge (58) and being elongated in cross section, said leading edges (58) defining a second plane (62) intersecting said first plane (60), said intersecting first and second planes (60,62) defining a planar angle (70), said leading tube (48') of said second core (14) being upstream of the other tubes (48) of said second core (14) in said fluid stream (F); and a flow control element (64) having a leading side (66) and a trailing side (68) and being positioned within said planar angle (70) and upstream and spaced a distance ($D_3$,$D_4$) from said first and second cores (12,14) in said fluid stream (F), said leading side (66) tangentially intersecting said first and second planes (60,62) and cooperating with said trailing side (68) to direct said fluid stream (F) onto and about said leading tubes (30',48') of said first and second cores (12,14) in a direction generally parallel to said leading tubes (30',48').

2. The heat exchanger (10), as set forth in claim 1, wherein each of said first and second cores (12,14) has a central axis (36,54), said central axes (36,54) intersecting at an angle (59) of from about 20° to about 78°.

3. The heat exchanger (10), as set forth in claim 1, wherein said first core (12) has a central axis (36) and each of said tubes (30) in said first core (12) has a longitudinal axis (32), said longitudinal axes (32) of said tubes (30) intersecting said central axis (36) at angles (34) of from about 100° to about 120°.

4. The heat exchanger (10), as set forth in claim 1, wherein said leading side (66) of said flow control element (64) extends along a constant radius (R) between said first and second planes (60,62).

5. The heat exchanger (10), as set forth in claim 1, wherein said leading side (66) of said flow control element (64) intersects said first and second planes (60,62) on the same radius (R).

6. The heat exchanger (10), as set forth in claim 1, wherein said trailing side (68) has a portion (74) parallel to said leading tube (30') of said first core (12).

7. The heat exchanger (10), as set forth in claim 1, wherein said first and second cores (12,14) are each defined by fins (16,18) and each have an inlet end (24,42) in which their respective leading tubes (30',48') are located, and said leading and trailing sides (66,68) of said flow control element (64) direct said fluid stream (F) through and completely about said fins (16,18) of said inlet ends (24,42).

* * * * *